US011882881B2

(12) United States Patent
Wei et al.

(10) Patent No.: US 11,882,881 B2
(45) **Date of Patent: *Jan. 30, 2024**

(54) ATOMIZATION DEVICE AND ELECTRONIC CIGARETTE WITH THE SAME

(71) Applicant: SHENZHEN SMOORE TECHNOLOGY LIMITED, Shenzhen (CN)

(72) Inventors: Yisong Wei, Shenzhen (CN); Xing Shi, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 279 days.

This patent is subject to a terminal disclaimer.

(21) Appl. No.: 17/233,500

(22) Filed: Apr. 18, 2021

(65) Prior Publication Data

US 2021/0235765 A1 Aug. 5, 2021

Related U.S. Application Data

(63) Continuation of application No. 16/158,322, filed on Oct. 12, 2018, now Pat. No. 11,006,672.

(30) Foreign Application Priority Data

Apr. 17, 2018 (CN) ..... 201810342016.9

(51) Int. Cl.
*A24F 40/485* (2020.01)
*A24F 40/40* (2020.01)
(Continued)

(52) U.S. Cl.
CPC ..... *A24F 40/485* (2020.01); *A24F 40/40* (2020.01); *A24F 40/42* (2020.01); *A24F 40/48* (2020.01); *A24F 15/015* (2020.01); *A24F 40/10* (2020.01)

(58) Field of Classification Search
CPC ..... A24F 40/40; A24F 40/42; A24F 40/48; A24F 40/10
See application file for complete search history.

(56) References Cited

FOREIGN PATENT DOCUMENTS

CN 205125041 U 4/2016
CN 206079036 U 4/2017
(Continued)

OTHER PUBLICATIONS

USPTO, Notice of Allowance and Fee(s) Due, Notice of References Cited (PTO-892), Search Note with Bibliographic Date, and IDS Considered, for U.S. Appl. No. 16/987,327, dated Oct. 4, 2022.
(Continued)

*Primary Examiner* — Kelly M Gambetta
*Assistant Examiner* — Jennifer A Kessie
(74) *Attorney, Agent, or Firm* — Zhigang Ma

(57) ABSTRACT

The present disclosure provides an atomization device and an electronic cigarette with the same. The atomization device includes a sleeving tube, a liquid storage cavity, and a liquid injection structure. A liquid injection opening is defined in one end of the sleeving tube, and both of the liquid injection opening and the air discharging opening communicate with the liquid storage cavity. The liquid injection structure includes a liquid injection tube, a first sealing member, and a second sealing member. The liquid injection tube runs through the sleeving tube, and a liquid inlet is formed in a side wall of the liquid injection tube. The first sealing member is arranged on one end of the liquid injection tube corresponding to the liquid storage cavity; and the second sealing member is arranged on an outer side of the liquid injection tube and seals the air discharging opening.

20 Claims, 6 Drawing Sheets

(51) Int. Cl.

| | |
|---|---|
| ***A24F 40/42*** | (2020.01) |
| ***A24F 40/48*** | (2020.01) |
| ***A24F 40/10*** | (2020.01) |
| ***A24F 15/015*** | (2020.01) |

(56) References Cited

FOREIGN PATENT DOCUMENTS

| | | | |
|---|---|---|---|
| CN | 105231492 | B | 9/2018 |
| CN | 105192896 | B | 10/2018 |
| CN | 208113975 | U | 11/2018 |
| CN | 208338874 | U | 1/2019 |

OTHER PUBLICATIONS

CNIPA, The First Office Action for CN201810342016.9, dated Feb. 18, 2023, total 13 pages.

ATOMIZATION DEVICE AND ELECTRONIC CIGARETTE WITH THE SAME

TECHNICAL FIELD

The present disclosure generally relates to substitutes for tobacco cigarettes, and more particularly, to an atomization device and an electronic cigarette with the same.

BACKGROUND

Electronic cigarettes are also known as virtual cigarettes or electronic atomizers. As substitutes for conventional tobacco cigarettes, the electronic cigarettes are often used for quitting smoking. With similar appearance and flavor to tobacco cigarettes, the electronic cigarettes are generally free of harmful chemicals like tar in the cigarettes or aerosol.

A typical electronic cigarette includes a liquid storage cavity, an atomizer arranged on one end of the liquid storage cavity, and a cigarette holder arranged on the other end of the liquid storage cavity. When tobacco liquid is used up, the cigarette holder needs to be unscrewed such that tobacco liquid can be injected into the liquid storage cavity. Such type of structure allows children to unscrew the electronic cigarette easily, contact the tobacco liquid, and even eat the tobacco liquid by mistake; in addition, leakage of liquid may occur during liquid injection.

SUMMARY OF THE DISCLOSURE

Therefore, the present disclosure aims to provide an improved atomization device and an electronic cigarette with the same.

An atomization device is provided, including a sleeving tube, a liquid storage cavity, and a liquid injection structure; wherein:

a liquid injection opening is defined in one end of the sleeving tube; at least one air discharging opening is defined in a side wall of the sleeving tube and both of the liquid injection opening and the air discharging opening communicate with the liquid storage cavity;

the liquid injection structure includes a liquid injection tube, a first sealing member and a second sealing member;

the liquid injection tube runs through the sleeving tube, a liquid inlet is formed in a side wall of the liquid injection tube; the first sealing member is arranged on one end of the liquid injection tube corresponding to the liquid storage cavity; the first sealing member seals the liquid injection opening and separates the liquid inlet from the liquid storage cavity; and the second sealing member is arranged on an outer side of the liquid injection tube and seals the air discharging opening;

when the liquid injection tube is pressed into the liquid storage cavity, the liquid injection tube moves into the liquid storage cavity, the first sealing member moves away from the liquid injection opening, the liquid inlet moves to be inside the liquid injection opening to communicate with the liquid storage cavity, the second sealing member is staggered from the air discharging opening such that the air discharging opening communicates with an external environment; and when the liquid injection tube is released, the liquid injection tube moves outwards to restore to its original position such that the liquid inlet separates from the liquid storage cavity and seals the air discharging opening.

In an embodiment, the sleeving tube includes a tube body and an annular blocking ring arranged on an inner ring of one end of the tube body;

the end of the sleeving tube where the blocking ring is located corresponds to the liquid storage cavity, and an inner hole of the blocking ring forms the liquid injection opening; and the first sealing member is located on an inner side of the blocking ring corresponding to the liquid storage cavity, and the first sealing member is tightly engaged with the inner side of the blocking ring.

In an embodiment, an inner end of the liquid injection tube is enclosed; and the first sealing member includes a mounting base and a sealing ring, the mounting base is arranged on the inner end of the liquid injection tube, and the sealing ring is sleeved on an outer ring of the mounting base.

In an embodiment, at least one annular protrusion is arranged on one side of the sealing ring adjacent to the liquid injection opening along a circumference of the side of the sealing ring.

In an embodiment, a plurality of the air discharging openings are circumferentially arranged on the sleeving tube; the second sealing member is annular and is sleeved on the liquid injection tube, and a clamping slot for holding the second sealing member is formed in the outer side of the liquid injection tube; and/or, the air discharging openings are axially arranged at different positions of the sleeving tube.

In an embodiment, the liquid injection structure further includes a resetting member respectively abutting the liquid injection tube and the sleeving tube, and the resetting member provides an elastic force for driving the sleeving tube to move outwards.

In an embodiment, the resetting member is sleeved on the liquid injection tube, a positioning stage is arranged on the liquid injection tube for abutting the resetting member, and one end of the resetting member abuts the positioning stage and the other end of the resetting member abuts the blocking ring.

In an embodiment, the atomization device further includes a liquid storage member, the liquid storage cavity is formed in the liquid storage member, and the liquid storage member defines a mounting hole in which the sleeving tube is inserted.

In an embodiment, a socket pipe section is sleeved on an outer end of the liquid injection tube, and an inner hole of the socket pipe section is greater than that of an inner hole of the liquid injection tube;

a trumpet-shaped guiding portion is arranged between the socket pipe section and the liquid injection tube, one end of the guiding portion is bigger than the other end thereof, and the bigger end of the guiding portion is connected to the socket pipe section, and the smaller end of the guiding portion is connected to the liquid injection tube; and the bigger end of the guiding portion is greater than that of an inner ring of the sleeving tube.

In an embodiment, an air discharging cavity is formed between an inner side of the sleeving tube and the liquid injection tube, an opening is formed in a surface of an outer end of the sleeving tube; and the air discharging opening, the air discharging cavity, and the opening form an air discharging passage communicating the liquid storage cavity with the external environment.

An electronic cigarette having the above atomization device of is further provided.

In the present disclosure, the air discharging opening is formed in the sleeving tube of the atomization device to communicate with the external environment; when the liquid injection tube is pressed by a liquid injection mouth or a liquid injection pipe on a tobacco liquid bottle for injecting tobacco liquid into the liquid injection tube, the air discharging opening is opened, tobacco liquid flows into the liquid storage cavity through the liquid inlet, and air in the liquid storage cavity discharges out of the liquid storage cavity through the air discharging opening to balance air pressure inside and outside the liquid storage cavity, thus, leakage of tobacco liquid from the liquid injection tube caused by the situation that tobacco liquid cannot be injected into the liquid storage cavity due to the air pressure can be avoided.

BRIEF DESCRIPTION OF THE DRAWINGS

The present disclosure will be described in more detail with reference to the accompany drawings and the embodiments, wherein in the drawings

PREFERRED EMBODIMENTS

The preferred embodiments are illustrated in detail with reference to the attached drawings so as to have a clearer understanding of the technical characteristics, purpose and effect of the present disclosure.

Figure 1:
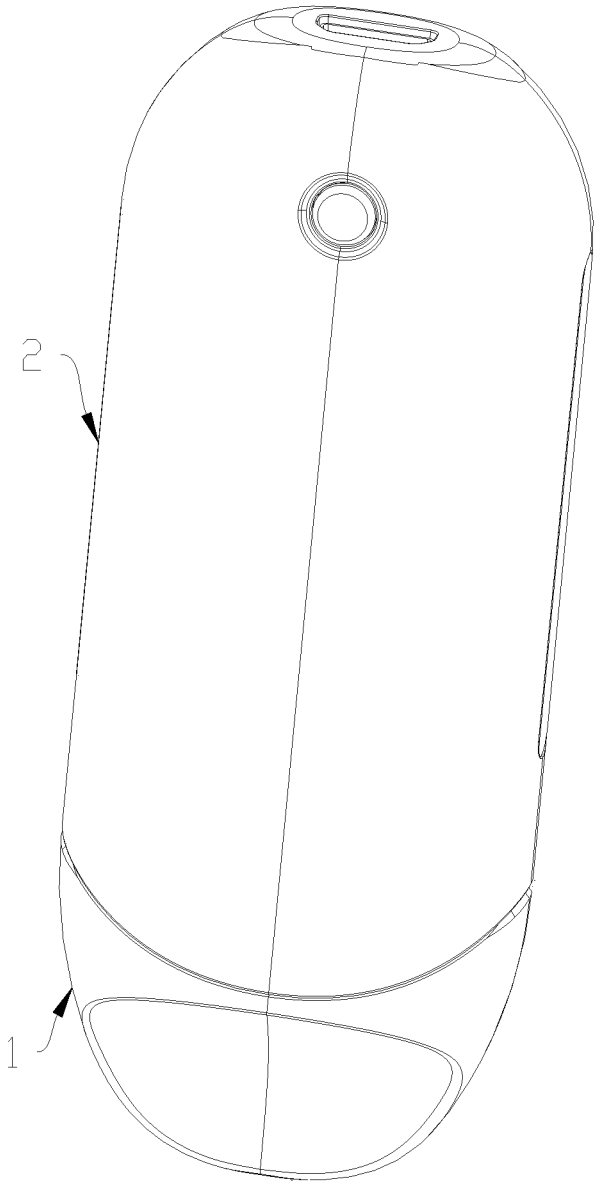
FIG. 1 is a schematic view of an electronic cigarette in accordance with an embodiment of the present disclosure.
Figure 2:
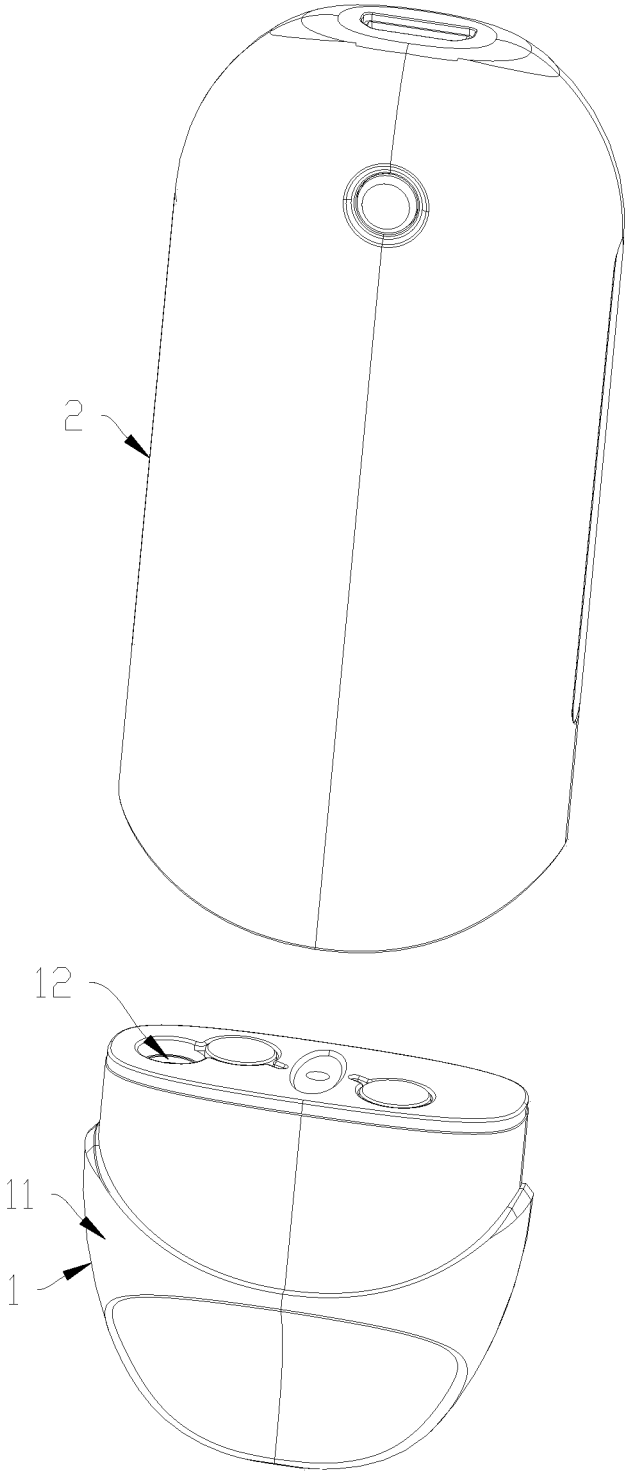
FIG. 2 is an exploded view of the electronic cigarette of FIG. 1.
Figure 3:
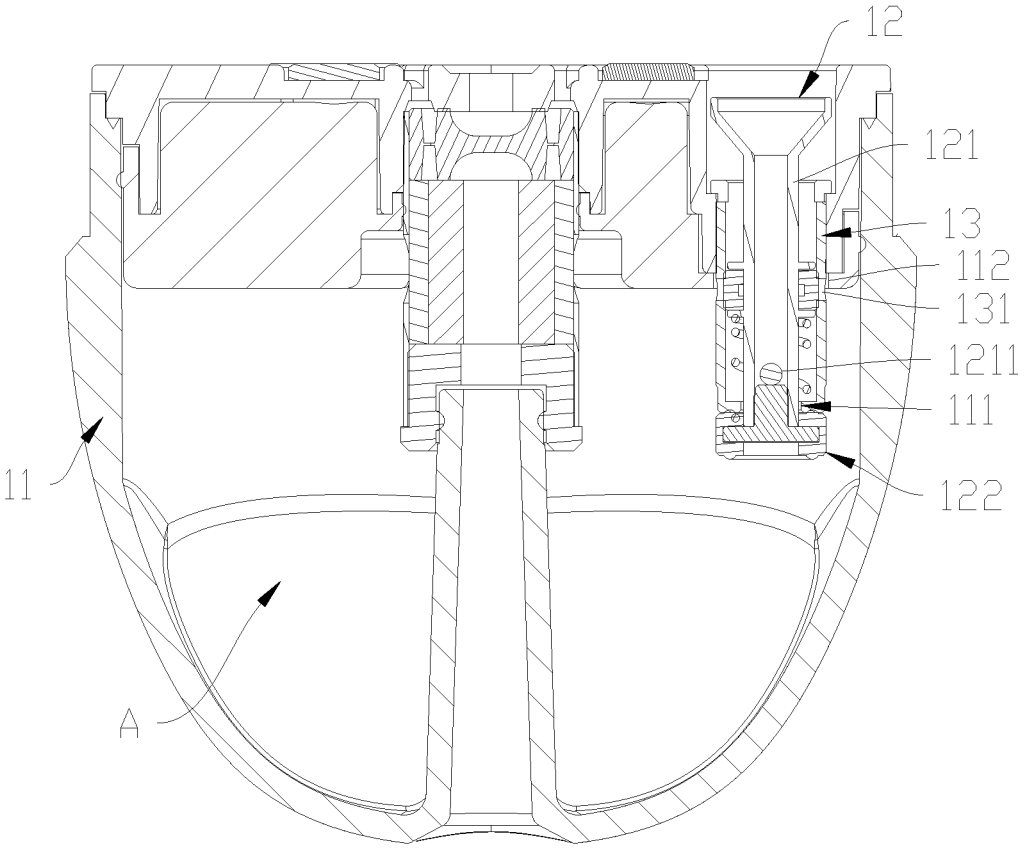
FIG. 3 is a cross sectional view showing that a liquid inlet is separated from a liquid storage cavity and an air discharging opening is enclosed when liquid is not injected into an atomization device of FIG. 2.
Figure 4:
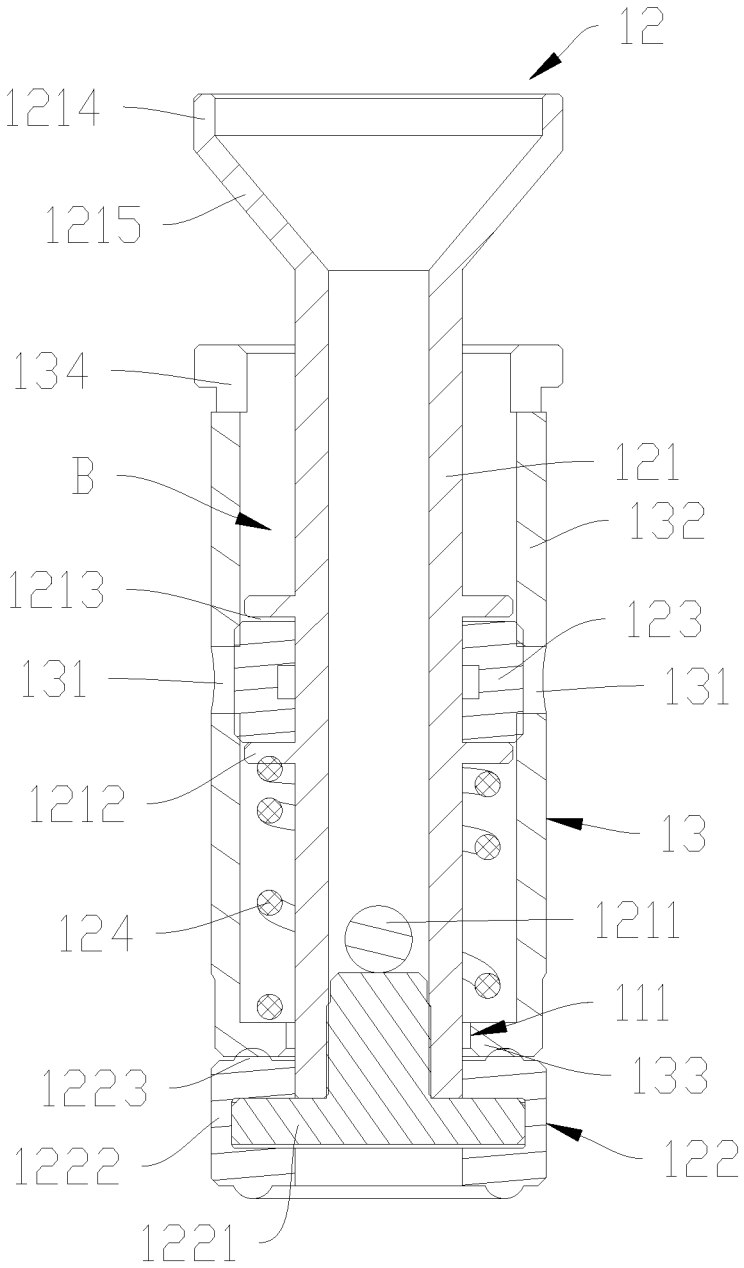
FIG. 4 is a cross sectional view showing a liquid injection structure is mounted to a sleeving tube of FIG. 3.
Figure 5:
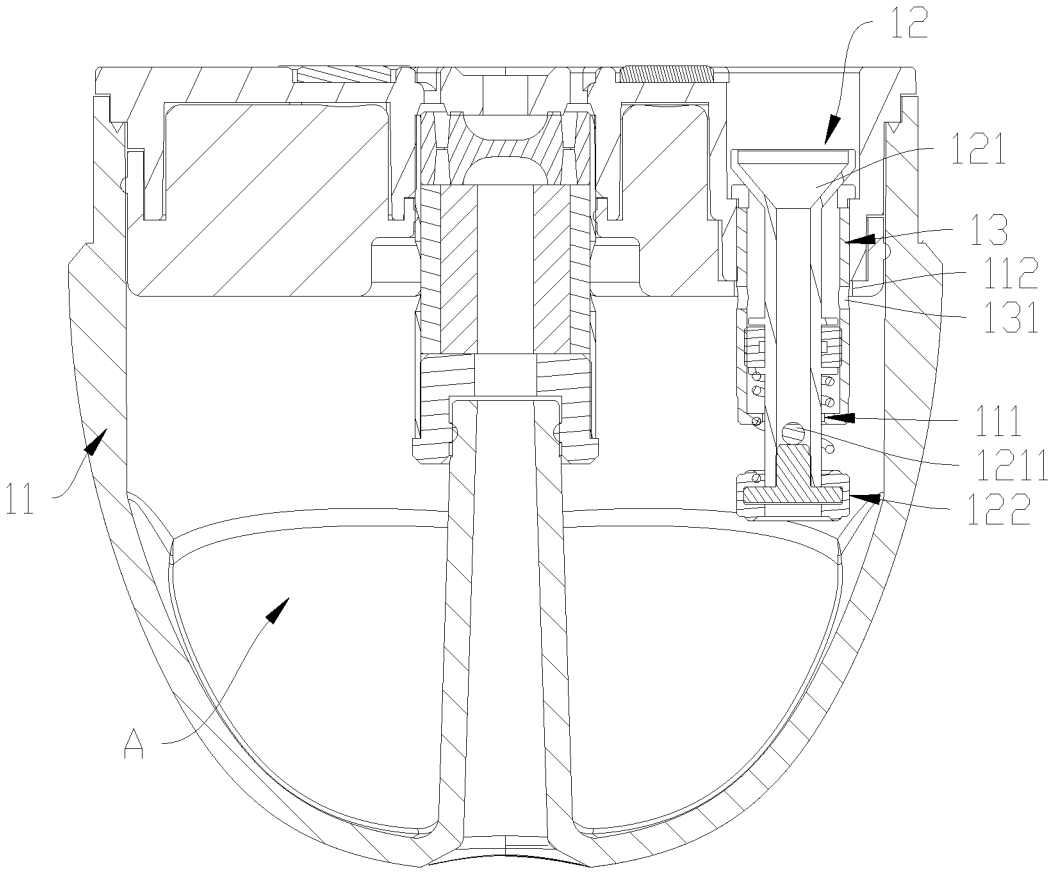
FIG. 5 is a cross sectional view showing that the liquid inlet communicates with the liquid storage cavity and the air discharging opening is opened when liquid is injected to the atomization device of FIG. 2; and, FIG. 6 is a cross sectional view showing that the liquid injection structure is mounted to the sleeving tube of FIG. 5.
Figure 6:
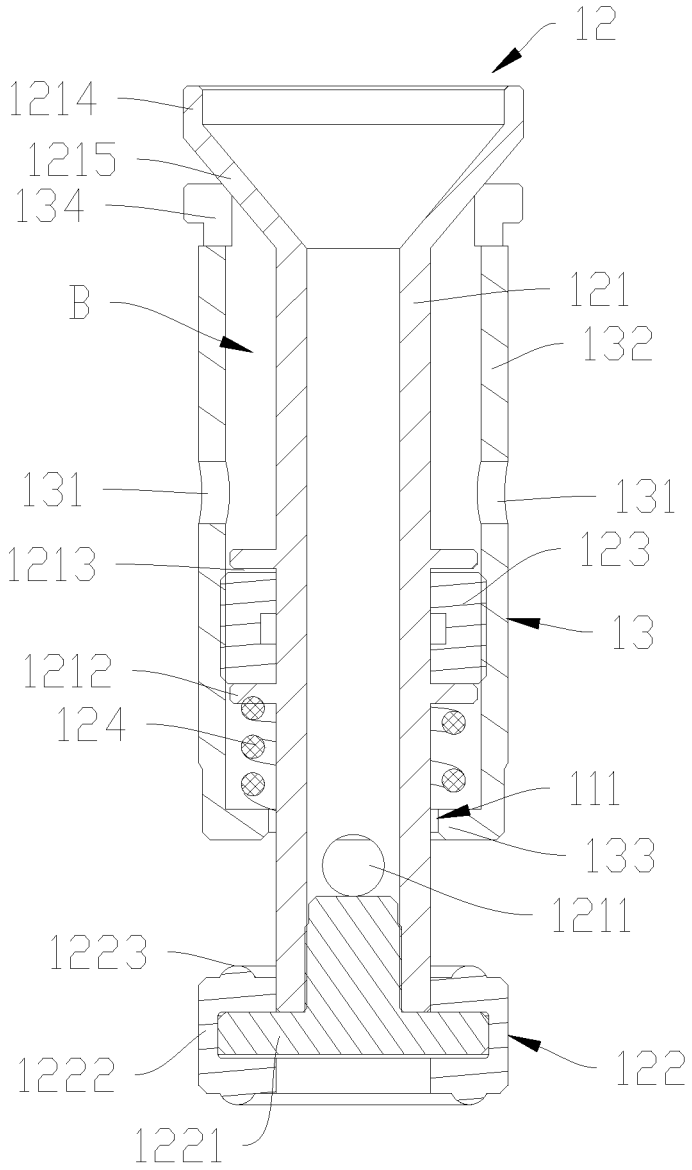

As shown in FIGS. 1 and 2, in an embodiment an electronic cigarette includes an atomization device 1 and a power supply device 2. The power supply device 2 supplies electric power for the atomization device 1 to heat and atomize tobacco liquid, thus, users can smoke the electronic cigarette.

The atomization device 1 includes a liquid storage member 11 and a liquid injection structure 12. A liquid storage cavity A is formed in the liquid storage member 11, and a liquid injection opening 111 is formed in the liquid storage member 11, thus, liquid can be injected to the liquid storage cavity A through the liquid injection opening 111.

In combination with FIGS. 3 to 6, a sleeving tube 13 is arranged in the liquid storage member 11, communicating an inside with an outside of the liquid storage cavity A. At least one air discharging opening 131 is formed in a side wall of the sleeving tube 13. Both the liquid injection opening 111 and the air discharging opening 131 communicate with the liquid storage cavity A.

The liquid injection structure 12 includes a liquid injection tube 121, a first sealing member 122, and a second sealing member 123. The liquid injection tube 121 runs through the sleeving tube 13. A liquid inlet 1211 is formed in a side wall of the liquid injection tube 121. The first sealing member 122 is arranged on one end of the liquid injection tube 121 corresponding to the liquid storage cavity A for sealing the liquid injection opening 111 and separating the liquid inlet 1211 from the liquid storage cavity A.

The second sealing member 123 is arranged on an outer side of the liquid injection tube 121 for sealing the air discharging opening 131.

When the liquid injection tube 121 is pressed into the liquid storage cavity A, the liquid injection tube 121 moves into the liquid storage cavity A, the first sealing member 122 moves away from the liquid injection opening 111, the liquid inlet 1211 moves to be inside the liquid injection opening 111 to communicate with the liquid storage cavity A, the second sealing member 123 is staggered from the air discharging opening 131, thus, the air discharging opening 131 communicates with the external environment.

When the liquid injection tube 121 is pressed by a liquid injection mouth or a liquid injection pipe on a tobacco liquid bottle for injecting tobacco liquid into the liquid injection tube 121, tobacco liquid flows into the liquid storage cavity A through the liquid inlet 1211, and air in the liquid storage cavity A discharges out of the liquid storage cavity A through the air discharging opening 131 to balance air pressure inside and outside the liquid storage cavity A, thus, leakage of tobacco liquid from the liquid injection tube 121 caused by the situation that tobacco liquid cannot be injected into the liquid storage cavity A due to the air pressure can be avoided.

When the liquid injection tube 121 is being pressed by the tobacco liquid bottle, a counterforce is applied to the liquid injection mouth of the tobacco liquid bottle to drive the liquid injection mouth to move inwards, thus, a liquid outlet of the liquid injection mouth is opened and tobacco liquid flows out of the liquid injection mouth after the liquid inlet 1211 of the liquid injection tube 121 communicates with the liquid storage cavity A. Tobacco liquid flows to the liquid storage cavity A through the liquid injection mouth, the liquid injection tube 121, and the liquid inlet 1211 from the tobacco liquid bottle, thereby being injected to the atomization device 1.

When the liquid injection tube 121 is released, the liquid injection tube 121 moves outwards to restore to its original position, thus, the liquid inlet 1211 is separated from the liquid storage cavity A and seals the air discharging opening 131.

The sleeving tube 13 includes a tube body 132 and an annular blocking ring 133 arranged on an inner ring of one end of the tube body 132. The end of the sleeving tube 13 where the blocking ring 133 is located corresponds to the liquid storage cavity A, and an inner hole of the blocking ring 133 forms the liquid injection opening 111.

The first sealing member 122 is located on an inner side of the blocking ring 133 corresponding to the liquid storage cavity A. The first sealing member 122 is tightly engaged with the inner side of the blocking ring 133 to avoid leakage of tobacco liquid.

In an embodiment, a mounting hole 112 is defined in the liquid storage member 11, and the sleeving tube 13 is inserted in the mounting hole 112. The end of the sleeving tube 13 where the blocking ring 133 is located corresponds to the liquid storage cavity A. An inner hole of the sleeving tube 13 where the blocking ring 133 is located forms the liquid injection opening 111. In an embodiment, the end of the sleeving tube 13 where the liquid injection opening 111 is located and the air discharging opening 131 are located in the liquid storage cavity A.

After the liquid injection tube 121 moves outwards from the liquid injection opening 111, the first sealing member 122 is tightly engaged with the inner side of the blocking ring 133 to prevent leakage of tobacco liquid in the liquid storage cavity A.

The position of an inner end of the sleeving tube 13 is not limited to this embodiment. The inner end of the sleeving tube 13 can be located in the liquid storage cavity A, be coplanar with an inner wall surface of the liquid storage cavity A, or embedded in an inner wall of the liquid storage member 11. The position of the blocking ring 133 also can be accordingly adjusted such that tobacco liquid can be injected to the liquid storage cavity A through the liquid injection opening 111 and air can discharge out of the electronic cigarette through the air discharging opening 131.

In other embodiments, the sleeving tube 13 can be integrally formed with the liquid storage member 11, a tube-shaped structure can be formed in a side wall of the liquid storage member 11 to form the sleeving tube 13 in which the liquid injection tube 121 is inserted.

The inner end of the liquid injection tube 121 is typically enclosed such that the first sealing member 122 is sleeved on the end of the liquid injection tube 121. The first sealing member 122 includes a mounting base 1221 and a sealing ring 1222. The mounting base 1221 is mounted on the inner end of the liquid injection tube 121, and the sealing ring 1222 is sleeved on an outer ring of the mounting base 1221.

The sealing ring 1222 is typically made of flexible material. An annular protrusion 1223 is arranged on a circumference of one side of the sealing ring 1222 adjacent to the liquid injection opening 111. The protrusion 1223 can be deformed easily to improve the sealing effect of the sealing ring 1222.

In other embodiments, the inner end of the liquid injection tube 121 is not enclosed; after the first sealing member 122 is mounted, the inner end of the liquid injection tube 121 is sealed by the liquid injection tube 121.

The liquid injection structure 12 further includes a resetting member 124 respectively abutting the liquid injection tube 121 and the sleeving tube 13, allowing the sleeving tube 13 to move outwards to restore to its original position. The resetting member 124 provides an elastic force to drive the sleeving tube 13 to move outwards, thus, the first sealing member 122 is sealed with the blocking ring 133.

In an embodiment, the resetting member 124 is sleeved on the liquid injection tube 121, and a positioning stage 1212 is arranged on the liquid injection tube 121 such that the resetting member 124 can abut the positioning stage 1212. One end of the resetting member 124 abuts the positioning stage 1212, and the other end of the resetting member 124 abuts the blocking ring 133. When the liquid injection tube 121 moves into the liquid storage cavity A, the resetting member 124 is compressed; after the tobacco liquid bottle is removed, the liquid injection tube 121 is released and the resetting member 124 drives the liquid injection tube 121 to restore to its original position.

In other embodiments, the liquid injection structure 12 can include a plurality of the resetting members 124 circumferentially arranged on the liquid injection tube 121. One end of the resetting member 124 is clamped to the positioning stage 1212 and the other end of the resetting member 124 is clamped to the blocking ring 133 to supply the elastic force to drive the liquid injection tube 121 to restore to its original position.

In some embodiments, in order to facilitate air discharging from different locations of the electronic cigarette, a plurality of the air discharging openings 131 are circumferentially arranged on the sleeving tube 13, the second sealing member 123 is annular and is sleeved on the liquid injection tube 121, and a clamping slot 1213 is arranged on an outer side of the liquid injection tube 121 in which the second sealing member 123 is mounted. In an embodiment, the clamping slot 1213 is formed on the positioning stage 1212. In other embodiments, the clamping slot 1213 can be independently arranged.

In other embodiments, the air discharging openings 131 can be axially arranged in different positions of the sleeving tube 13, and each of the air discharging openings 131 can be sealed by one second sealing member 123. In other embodiments, at least one protruding sealing stage can be arranged on the second sealing member 123, and each protruding sealing stage can seal one or more air discharging openings 131.

It can be understood that the air discharging openings 131 can be both circumferentially and axially arranged on the sleeving tube 13. Each air discharging opening 131 may have any shape. When the air discharging opening 131 is circular, air discharging effect is good and the forming process of the circular opening is relatively easy; when the air discharging opening 131 is oval rather than circular, liquid film may not be easily formed and air discharging effect may not be affected.

When the air discharging opening 131 is circular, a diameter of the air discharging opening 131 ranges from 0.6 cm to 0.8 cm. When the diameter of the air discharging opening 131 is 0.6 cm, the air discharging effect is good and the sealing effect may not be affected since the air discharging opening 131 is relatively small. When the diameter of the air discharging opening 131 is 0.8 cm, the opening can be easily formed during the manufacturing process of the electronic cigarette.

A socket pipe section 1214 is sleeved on an outer end of the liquid injection tube 121. An inner hole of the socket pipe section 1214 is greater than that of the inner hole of the liquid injection tube 121, thus, when liquid injection is required, the liquid injection mouth of the tobacco liquid bottle can be easily inserted into the socket pipe section 1214; moreover, the liquid injection mouth can apply a pressing force to the liquid injection tube 121 with the size difference between the socket pipe section 1214 and the liquid injection tube 121.

In some embodiments, a trumpet-shaped guiding portion 1215 is arranged between the socket pipe section 1214 and the liquid injection tube 121. One end of the guiding portion 1215 is bigger than the other end thereof. The bigger end of the guiding portion 1215 is connected to the socket pipe section 1214, and the smaller end of the guiding portion 1215 is connected to the liquid injection tube 121. The liquid injection mouth of the tobacco liquid bottle can get as close as to the outer end of the liquid injection tube 121 along the guiding portion 1215 and press the liquid injection tube 121 towards the liquid storage cavity A through the guiding portion 1215. In addition, tobacco liquid can flow to the liquid injection tube 121 through an oblique surface of the guiding portion 1215.

Furthermore, the bigger end of the guiding portion 1215 is greater than the inner ring of the sleeving tube 13. When tobacco liquid is injected to the electronic cigarette from the tobacco liquid bottle, the guiding portion 1215 abuts the outer end of the sleeving tube 13, limiting the movement of the liquid injection tube 121 towards the liquid storage cavity A. Thus, excessive movement of the liquid injection tube 121 can be prevented to avoid damage to other components caused by the liquid injection tube 121.

An air discharging cavity B is formed between the sleeving tube 13 and the liquid injection tube 121. An opening 134 is formed in an end surface of the outer end of the sleeving tube 13. The air discharging opening 131, the air discharging cavity B, and the opening 134 form an air discharging passage communicating the liquid storage cavity A with the external environment. When the guiding portion 1215 abuts the outer end of the sleeving tube 13, the air discharging cavity B can discharge air normally by communicating with the external environment through the opening 134.

It can be understood that although the alternative solutions of the heater and the porous body in the above mentioned embodiments mainly elaborate the difference from those in the embodiments pre mentioned, if they are not contradictory, they can replace with each other. For example, the heater in any embodiment above mentioned can cooperate with the porous body in any embodiment and any heating assembly above mentioned can be applied into the electronic cigarette.

What mentioned above are only the embodiments of the present disclosure, which are not to limit the scope of the patent of the present disclosure. Any equivalent structure or equivalent transformation of the procedure made with the specification and the pictures attached of the present disclosure, or directly or indirectly using the specification and the pictures attached of the present disclosure into other relevant technical fields, is included in the scope of the patent protection of the present disclosure.

What is claimed is:

1. An atomization device (1) comprising a sleeving tube (13), a liquid storage cavity (A), and a liquid injection tube (121); wherein:

the sleeving tube (13) defines at least one air discharging opening (131) communicating with the liquid storage cavity (A); and the liquid injection tube (121) runs through the sleeving tube (13) and defines a liquid inlet (1211);

when the liquid injection tube (121) is pressed inwards, the liquid injection tube (121) moves inwards to communicate the liquid inlet (1211) with the liquid storage cavity (A), and to communicate the at least one air discharging opening (131) with an external environment; and when the liquid injection tube (121) is released, the liquid injection tube (121) moves outwards to restore to its original position to isolate the liquid inlet (1211) from the liquid storage cavity (A), and to isolate the air discharging opening (131) from the external environment.

2. The atomization device (1) of claim 1, wherein the at least one air discharging opening (131) is defined in a side wall of the sleeving tube (13), and the liquid inlet (1211) is defined in a side wall of the liquid injection tube (121).

3. The atomization device (1) of claim 1, wherein a liquid injection opening (111) is defined in an inner end of the sleeving tube (13); and the atomization device (1) further comprises a first sealing member (122) configured for sealing the liquid injection opening (111).

4. The atomization device (1) of claim 3, wherein the sleeving tube (13) comprises a tube body (132) and an annular blocking ring (133) arranged on an inner end of the tube body (132), and an inner hole of the blocking ring (133) defines the liquid injection opening (111); and the first sealing member (122) is arranged on an inner side of the blocking ring (133) towards the liquid storage cavity (A), and the first sealing member (122) is tightly engaged with the inner side of the blocking ring (133).

5. The atomization device (1) of claim 3, wherein the first sealing member (122) comprises a mounting base (1221) and a sealing ring (1222); the mounting base (1221) is embedded into an inner end of the liquid injection tube (121) to enclose the inner end of the liquid injection tube (121), and the sealing ring (1222) is sleeved on an outer periphery of the mounting base (1221).

6. The atomization device (1) of claim 1, wherein the atomization device (1) further comprises a second sealing member (123) configured for sealing the at least one air discharging opening (131).

7. The atomization device (1) of claim 6, wherein a number of the air discharging openings (131) are circumferentially arranged on the sleeving tube (13), the second sealing member (123) is annular and is sleeved on the liquid injection tube (121), and an outer side of the liquid injection tube (121) is provided with a clamping slot (1213) for holding the second sealing member (123).

8. The atomization device (1) of claim 1, wherein the atomization device (1) further comprises a resetting member (124) respectively connected with the liquid injection tube (121) and the sleeving tube (13) to provide an elastic force for the liquid injection tube (121) to move outwards.

9. The atomization device (1) of claim 8, wherein the resetting member (124) is sleeved on the liquid injection tube (121); the liquid injection tube (121) is provided with a positioning stage (1212), and two ends of the resetting member (124) respectively abut against the positioning stage (1212) and the blocking ring (133).

10. The atomization device (1) of claim 1, wherein the atomization device (1) further comprises a liquid storage member (11), the liquid storage cavity (A) is defined in the liquid storage member (11), and the liquid storage member (11) defines a mounting hole (112) in which the sleeving tube (13) is inserted.

11. The atomization device (1) of claim 1, wherein a socket pipe section (1214) is provided on an outer end of the liquid injection tube (121), and an outer dimension of an inner hole of the socket pipe section (1214) is larger than that of an inner hole of the liquid injection tube (121); and a trumpet-shaped guiding portion (1215) is provided between the socket pipe section (1214) and the liquid injection tube (121).

12. The atomization device (1) of claim 1, wherein an air discharging cavity (B) is defined between an inner side of the sleeving tube (13) and an outer side of the liquid injection tube (121), and an opening (134) is defined in an outer end surface of the sleeving tube (13); the at least one air discharging opening (131), the air discharging cavity (B), and the opening (134) are communicated sequentially to define an air discharging passage communicating the liquid storage cavity (A) with the external environment.

13. An electronic cigarette comprising an atomization device (1), wherein the atomization device (1) comprises a sleeving tube (13), a liquid storage cavity (A), and a liquid injection tube (121); the sleeving tube (13) defines at least one air discharging opening (131) communicating with the liquid storage cavity (A); and the liquid injection tube (121) runs through the sleeving tube (13) and defines a liquid inlet (1211);

when the liquid injection tube (121) is pressed inwards, the liquid injection tube (121) moves inwards to communicate the liquid inlet (1211) with the liquid storage cavity (A), and to communicate the at least one air discharging opening (131) with an external environment; and when the liquid injection tube (121) is released, the liquid injection tube (121) moves outwards to restore to its original position to isolate the liquid inlet (1211) from the liquid storage cavity (A), and to isolate the air discharging opening (131) from the external environment.

14. The electronic cigarette of claim 13, wherein the at least one air discharging opening (131) is defined in a side wall of the sleeving tube (13), and the liquid inlet (1211) is defined in a side wall of the liquid injection tube (121).

15. The electronic cigarette of claim 13, wherein a liquid injection opening (111) is defined in an inner end of the sleeving tube (13); and the atomization device (1) further comprises a first sealing member (122) configured for sealing the liquid injection opening (111).

16. The electronic cigarette of claim 13, wherein the atomization device (1) further comprises a second sealing member (123) configured for sealing the at least one air discharging opening (131).

17. The electronic cigarette of claim 13, wherein the atomization device (1) further comprises a resetting member (124) respectively connected with the liquid injection tube (121) and the sleeving tube (13) to provide an elastic force for the liquid injection tube (121) to move outwards.

18. The electronic cigarette of claim 13, wherein the atomization device (1) further comprises a liquid storage member (11), the liquid storage cavity (A) is defined in the liquid storage member (11), and the liquid storage member (11) defines a mounting hole (112) in which the sleeving tube (13) is inserted.

19. The electronic cigarette of claim 13, wherein a socket pipe section (1214) is provided on an outer end of the liquid injection tube (121), and an outer dimension of an inner hole of the socket pipe section (1214) is larger than that of an inner hole of the liquid injection tube (121); and a trumpet-shaped guiding portion (1215) is provided between the socket pipe section (1214) and the liquid injection tube (121).

20. The electronic cigarette of claim 13, wherein an air discharging cavity (B) is defined between an inner side of the sleeving tube (13) and an outer side of the liquid injection tube (121), and an opening (134) is defined in an outer end surface of the sleeving tube (13); the at least one air discharging opening (131), the air discharging cavity (B), and the opening (134) are communicated sequentially to define an air discharging passage communicating the liquid storage cavity (A) with the external environment.

* * * * *